US007690207B2

(12) United States Patent
Markarian et al.

(10) Patent No.: US 7,690,207 B2
(45) Date of Patent: Apr. 6, 2010

(54) GAS TURBINE FLOATING COLLAR ARRANGEMENT

(75) Inventors: Lorin Markarian, Etobicoke (CA); Bhawan B. Patel, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 722 days.

(21) Appl. No.: 11/588,339

(22) Filed: Oct. 27, 2006

(65) Prior Publication Data

US 2008/0016874 A1 Jan. 24, 2008

Related U.S. Application Data

(63) Continuation-in-part of application No. 10/924,209, filed on Aug. 24, 2004, now Pat. No. 7,140,189, and a continuation-in-part of application No. 10/924,208, filed on Aug. 24, 2004, now Pat. No. 7,134,286.

(51) Int. Cl.
*F02C 7/20* (2006.01)

(52) U.S. Cl. ..... 60/796; 60/800; 60/752

(58) Field of Classification Search ..... 60/796–800, 60/740, 804, 752–760
See application file for complete search history.

(56) References Cited

U.S. PATENT DOCUMENTS

| | | | | | |
|---|---|---|---|---|---|
| 3,972,182 | A * | 8/1976 | Salvi | 60/743 |
| 4,458,479 | A * | 7/1984 | Reider et al. | 60/800 |
| 4,870,818 | A * | 10/1989 | Suliga | 60/740 |
| 4,914,918 | A * | 4/1990 | Sullivan | 60/756 |
| 4,934,145 | A * | 6/1990 | Zeisser | 60/756 |
| 5,172,545 | A * | 12/1992 | Forestier | 60/800 |
| 5,239,832 | A * | 8/1993 | Koshoffer et al. | 60/740 |
| 5,253,471 | A * | 10/1993 | Richardson | 60/804 |
| 5,279,127 | A * | 1/1994 | Napoli | 60/754 |
| 5,483,794 | A * | 1/1996 | Nicoll et al. | 60/766 |
| 5,533,330 | A * | 7/1996 | Mullooly et al. | 60/799 |
| 5,542,246 | A * | 8/1996 | Johnson et al. | 60/804 |
| 5,553,455 | A * | 9/1996 | Craig et al. | 60/753 |
| 5,577,379 | A * | 11/1996 | Johnson | 60/796 |
| 6,098,397 | A * | 8/2000 | Glezer et al. | 60/772 |
| 6,389,792 | B1 * | 5/2002 | Hagle et al. | 60/772 |
| 6,438,958 | B1 * | 8/2002 | McCaffrey et al. | 60/752 |
| 6,502,400 | B1 * | 1/2003 | Freidauer et al. | 60/772 |
| 6,557,349 | B1 * | 5/2003 | Young et al. | 60/752 |
| 6,675,582 | B2 * | 1/2004 | Monty et al. | 60/752 |
| 6,761,031 | B2 * | 7/2004 | Bunker | 60/752 |
| 6,880,341 | B2 * | 4/2005 | Parkman et al. | 60/740 |
| 7,540,155 | B2 * | 6/2009 | Taut | 60/752 |
| 2004/0006995 | A1 * | 1/2004 | Snyder | 60/796 |

* cited by examiner

*Primary Examiner*—William H Rodriguez
(74) *Attorney, Agent, or Firm*—Ogilvy Renault LLP

(57) ABSTRACT

A crack-resistant floating collar mounting arrangement is provided comprising a collar mounted between spaced-apart mounting flanges, the flange being fixed to a dome from an outer surface unexposed to the hot combustor temperatures.

6 Claims, 4 Drawing Sheets

GAS TURBINE FLOATING COLLAR ARRANGEMENT

CROSS-REFERENCE TO RELATED APPLICATIONS

This is a Continuation-In-Part of application Ser. Nos. 10/924,208 now U.S. Pat. No. 7,134,286 and Ser. No. 10/924,209 now U.S. Pat. No. 7,140,189 both filed on Aug. 24, 2004.

TECHNICAL FIELD

The invention relates generally to gas turbine engine combustors and, more particularly, to a floating collar arrangement therefor.

BACKGROUND OF THE ART

Gas turbine combustors are typically provided with floating collars or seals to permit relative radial or lateral motion between the combustor and the fuel nozzle while minimizing leakage therebetween. The collar is typically welded to the edge of a fuel nozzle hole defined in the dome end portion of the combustor wall. The collar is subject to wear and heat. Radial cracks occur around the fuel nozzle hole, and floating collar assemblies crack due to the metal being exposed to hot air. One cause of the cracking is that the thermal barrier coating, applied on the inner surface of the combustor wall near the fuel nozzle hole, cannot be brought to the edge of the fuel nozzle hole to protect the metal due to weld contamination. A band of unprotected metal must be left exposed in order to perform the weld and, thus, secure the floating collar to the combustor wall. In addition, the welds are exposed to hot air, which inevitably results in cracking.

Accordingly, there is a need to provide a solution which addresses these and other limitations of the prior art, and in particular, there is a need to reduce the occurrence of cracking on gas turbine combustors.

SUMMARY OF THE INVENTION

In one aspect, the present invention provides a floating collar and combustor arrangement for receiving a fuel nozzle, comprising: a combustor having an opening defined in a dome thereof for receiving the fuel nozzle, the combustor having an inner surface and an outer surface; a mounting arrangement comprising a mounting flange circumscribing the opening, the mounting flange being fixedly bonded from outside of the combustor to the outer surface thereof, and a cap spaced-apart in an axial direction relative to the combustor from the mounting flange, the cap fixed to the mounting flange; a floating collar slidably trapped between the mounting flange and the cap such that relative axial movement is substantially restrained but relative radial movement is permitted, the floating collar having a central aperture substantially aligned with the opening in the dome and adapted for receiving the fuel nozzle; and a thermal barrier applied to the inner surface of the combustor all the way to an edge of the opening in the dome.

In another aspect, the present invention provides a method of mounting a floating collar assembly to a combustor of gas turbine engine, the method comprising: fixedly bonding the floating collar assembly from outside of the combustor to an outer surface of the combustor such that a central opening of the floating collar assembly be substantially aligned with an opening of the combustor for receiving a fuel nozzle.

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
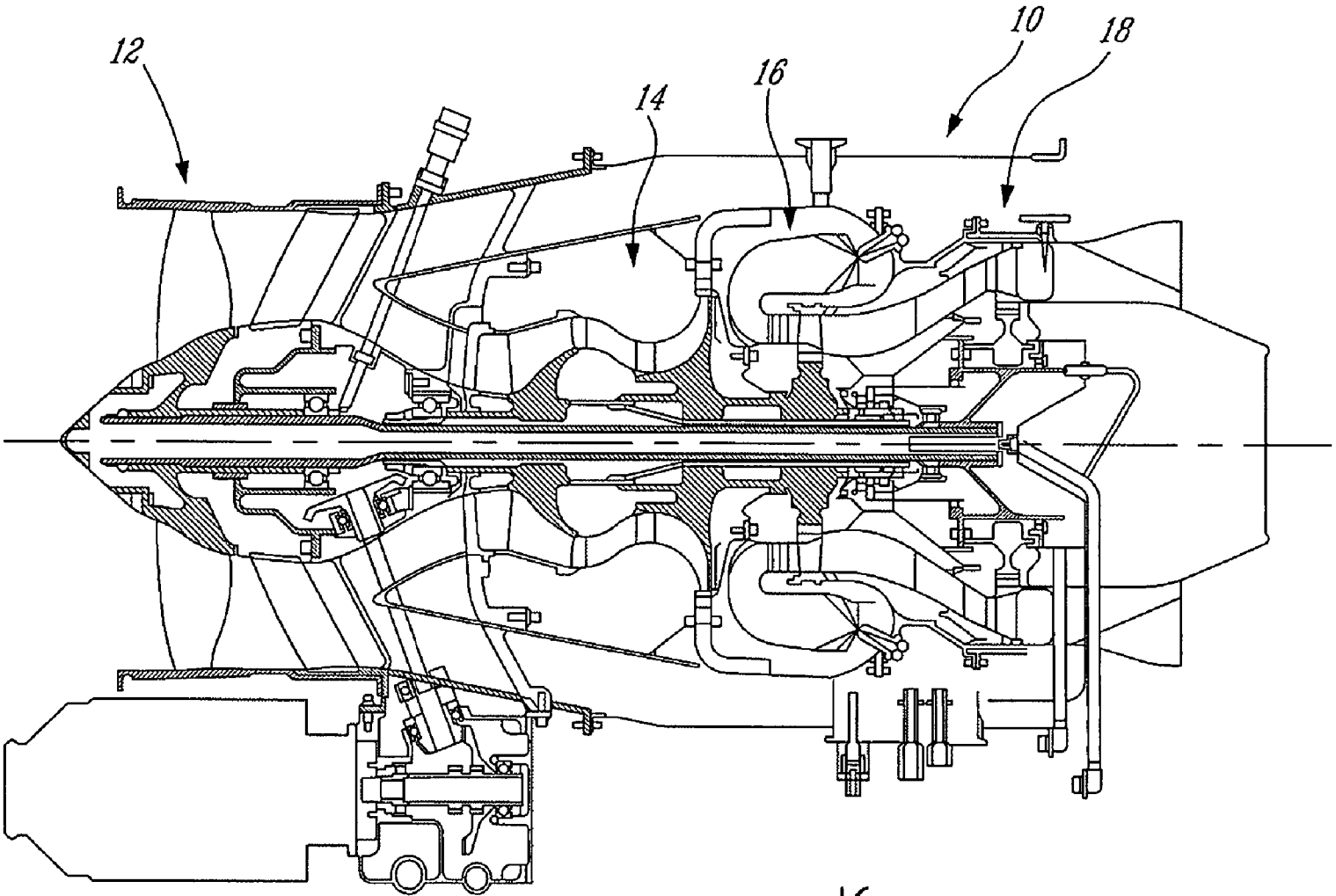
FIG. 1 is a schematic longitudinal sectional view of a turbofan engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
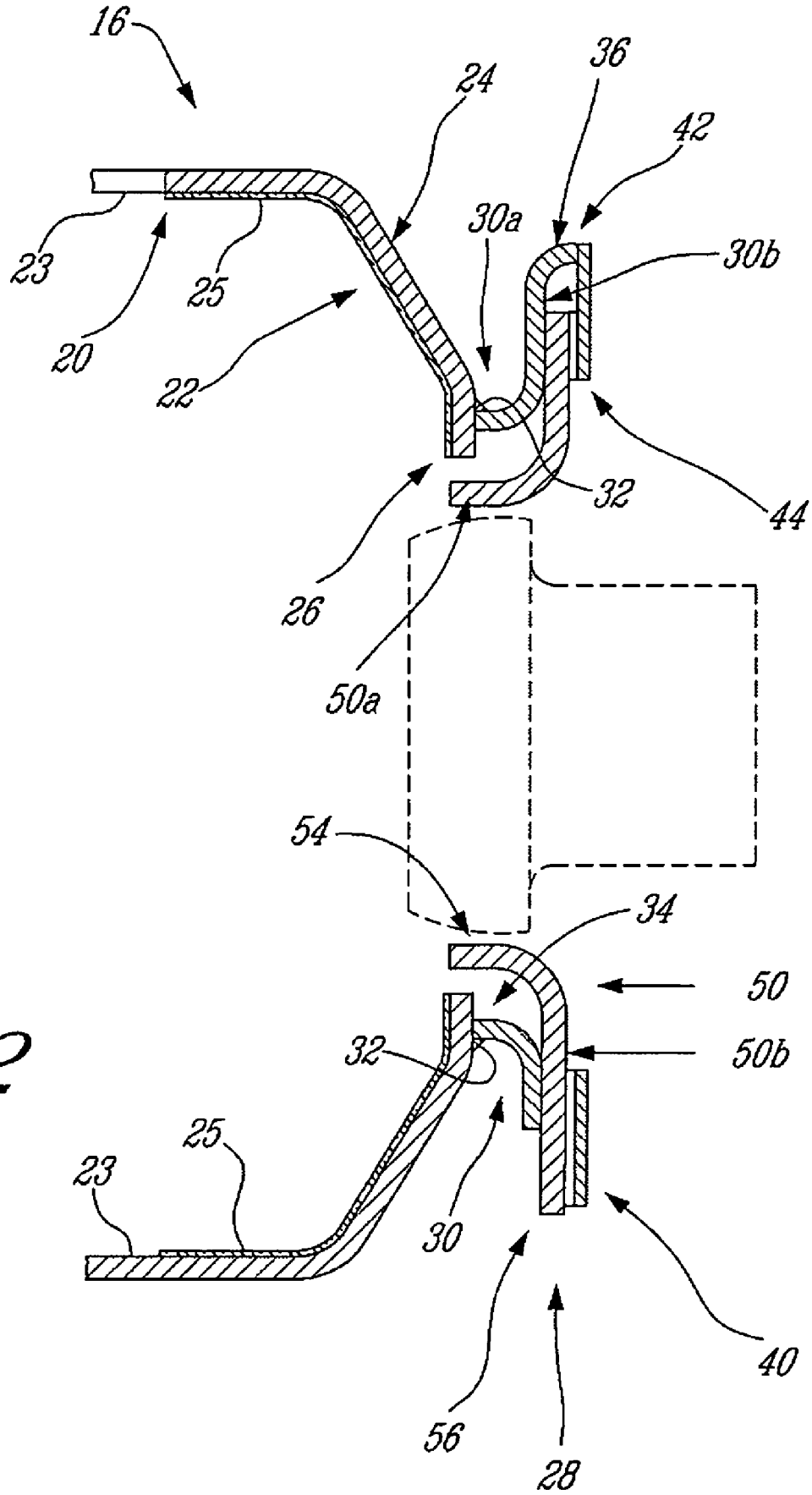
FIG. 2 is a partial sectional view of a combustor in accordance with an embodiment of the present invention.
Figure 3:
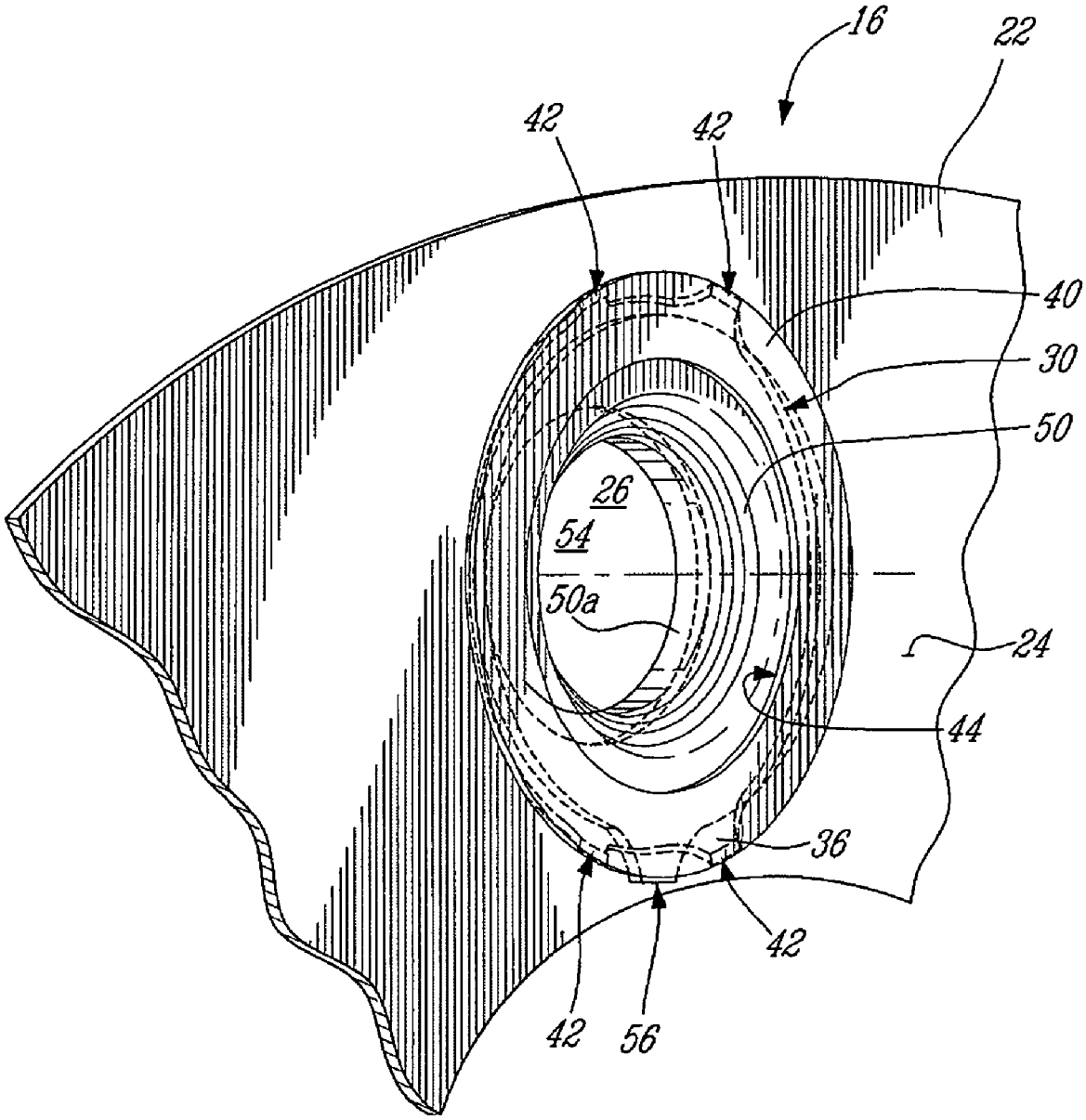
FIG. 3 is an isometric view of a portion of FIG. 2.

FIG. 2 shows an enlarged axial sectional view of an annular combustor 16 comprising a combustor wall or liner 20 defining a dome 22 having inner and outer surfaces 23 and 24 and a circumferential array of central fuel nozzle openings (only one being shown at 26) for receiving a plurality air swirler fuel nozzles (one being depicted in stippled lines in FIG. 2) of the type generally described in U.S. Pat. Nos. 6,289,676 or 6,082,113, for example, and which are incorporated herein by reference. Each fuel nozzle is associated with a floating collar arrangement 28.

The floating collar arrangement 28 generally comprises an annular mounting flange 30, an annular cap 40 and a floating collar 50 mounted between the mounting flange 30 and the cap 40.

The mounting flange 30 has a forwardly projecting annular lip 30*a*, a radially disposed annular flange portion 30*b*, both defining a central aperture 34 therein. Central aperture 34 can be aligned with dome opening 26 when mounting flange 30 is mounted on the combustor 16. Mounting flange 30 may also include a plurality of rearwardly projecting legs 36 as will be described further below.

As shown in FIG. 2, the mounting flange 30 is mounted from the outside of the combustor 16. More particularly, the mounting flange 30 is fixed along the annular lip 30*a* thereof, preferably by braze 32, to the outer surface 24 of dome 22. The soldering, done using a hard solder with a high melting point, such as with an alloy of zinc and copper, is done from the outside of the flange 30, i.e. at the connection point 32 between the outer surface 24 of the dome 22 and the radially outer side of the forwardly projecting lip 30*a* opposite the side facing the opening 26. The braze is on the outside of the assembly outside of the combustor and therefore not exposed to the hot combustor temperatures coming through the central opening 26. The outside mounting of flange 30 advantageously allows to apply a thermal barrier coating 25 to the inner surface 23 of the liner 22 all the way to the edge of the fuel nozzle opening 26, protecting the entire surface of the dome from the hot air. The thermal barrier coating 25 is applied before brazing but it does not melt and is thus unaffected by braze, due to lower braze temperatures and remote location. This allows the thermal barrier coating 25 to come to the edge of the part, protecting the entire metal.

The annular cap 40 has a central aperture 44 which is aligned with dome opening 26 and the mounting flange aperture 34 when mounted on combustor 16 for receiving the fuel nozzle therein. The annular cap 40 is mounted at 42, such as by welding, to the rearwardly projecting legs 36 of mounting flange 30. Alternatively, cap 40 could be brazed to the mounting flange 30, from the outer surface, i.e. at the connection point of the outer surface of the flange 30 and the outer surface of the cap 40.

The floating collar 50 is disposed axially between the mounting flange 30 and the cap 40. The floating collar 50 has an axially forwardly projecting nozzle collar portion 50*a*, and a radially disposed annular flange portion 50*b*, both surrounding a central aperture 54, and a smooth transition from axial to radial joins portions 50*a* and 50*b*. Central aperture 54 and collar portion 50*a* are provided for axially slidingly engaging a circumferential shoulder of the fuel nozzle swirler body (stippled lines in FIG. 2). Collar portion 50*a* preferably extends to, or inside, dome 22 though opening 26. Flange portion 50*b* is trapped between, opposed surfaces of mounting flange 30 and cap 40, with mounting flange 30 and cap 40 being sufficiently spaced apart to permit radial (relative to the engine axis of FIG. 1) sliding motion to occur between floating collar 50 and the mounting flange and cap sub-assembly. An anti-rotation tang 56 depends from flange portion 50*b* and is likewise trapped between adjacent mounting flange legs 36, to thereby limit the amount by which floating collar 50 may rotate relative to mounting flange and cap sub-assembly.

In use, the fuel nozzle air swirler is positioned within central aperture 54 and delivers a fuel air mixture to combustor 16. As forces acting upon the fuel nozzle and the combustor 16 tend to cause relative movement therebetween, floating collar 50 is able to displace radially with the nozzle while maintaining sealing with respect to combustor 16 through maintaining sliding engagement with mounting flange 30 and cap 40. Connection points 32 and 42 ensure that mounting flange 30 and cap 40 maintain their spaced-apart relation and thereby keep floating collar 50 trapped therebetween. In accordance with one embodiment of the invention, both connection points 32 and 42 are brazed from the outside of the assembly such that the braze is not exposed to the hot combustor temperatures. As mentioned herein above, the external mounting is advantageous in that a thermal barrier coating 25 can be applied to the inner surface 23 of the dome 22 all the way to the edge of the opening 26, protecting all metal, preventing radial cracks to appear in rows of holes around the opening 26 and preventing weld crack of the mounting arrangement 28.

Figure 4:
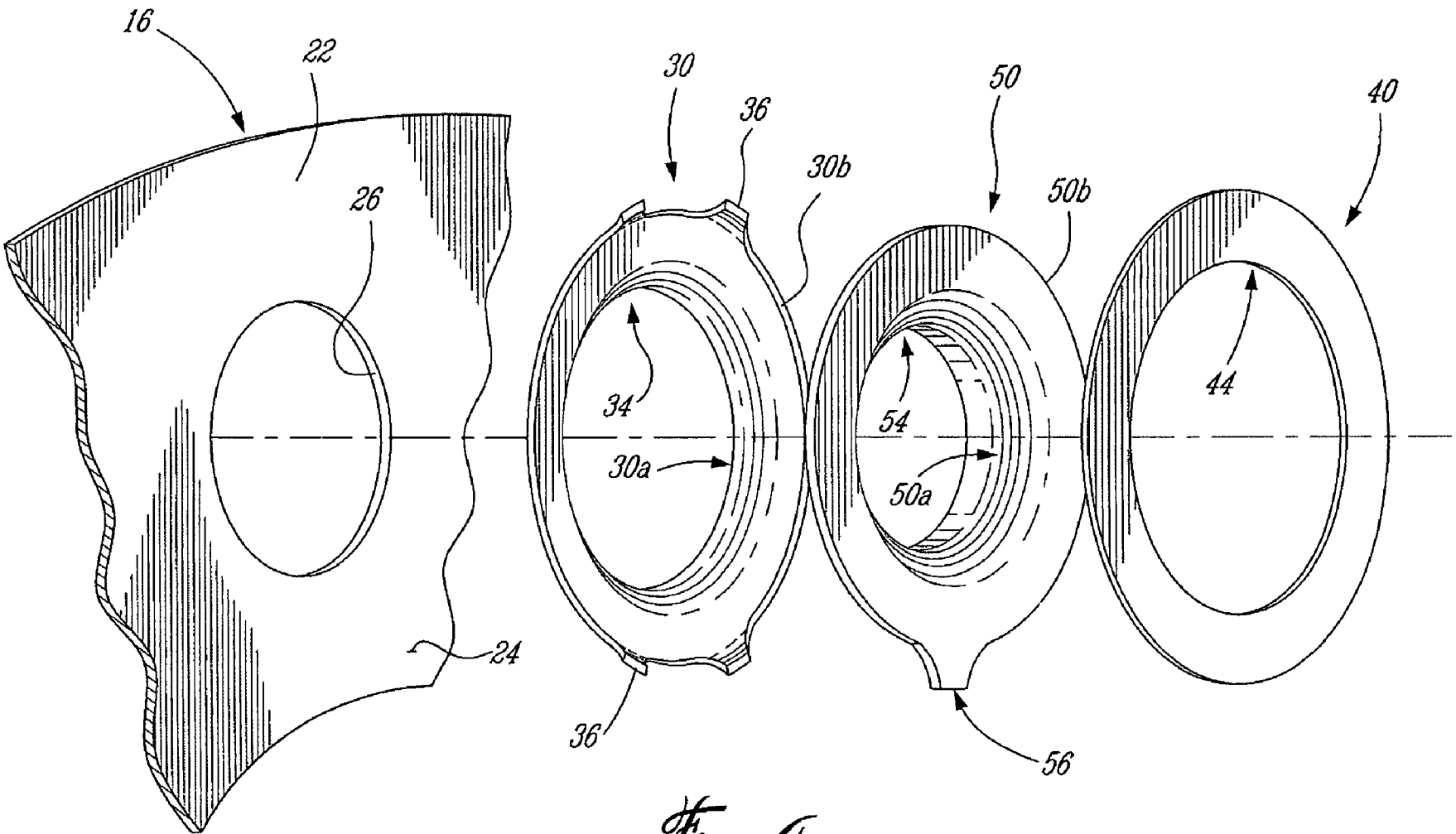
FIG. 4 is an exploded isometric view of FIG. 3.

Referring to FIG. 4, mounting arrangement 28 is assembled through a process involving at least the following steps: brazing mounting flange 30 to combustor dome 22 at an outer surface 24 thereof so that the flange central opening 34 is generally aligned with dome opening 26; inserting floating collar 50 into the mounting flange 30, so that the collar portion 50*a* extends through central opening 34 and is generally aligned with dome opening 26, and preferably also so that anti-rotation tang 56 is trapped between two closely adjacent legs 36; and fixing cap 40 to mounting flange 30, preferably at legs 36, to slidingly trap the floating collar 50 between cap 40 and the mounting flange 30. The step of fixing cap 40 to mounting flange 30 may also be a brazing step, by applying the solder at an outer surface of both the cap 40 and the flange 30. The order of operations may be any suitable, and need not be chronologically as described.

Floating collar arrangement 28 and floating collar 50 are preferably provided from sheet metal using a suitable fabrication process. A simplified example process is to provide a sheet of metal, cut a blank, and perform at least one bending operation to provide the floating collar. Referring again to FIG. 2, it is illustrated that a sheet metal collar 50 has a continuous transition provided as a result of a sheet metal forming operation, such as bending, and helps strengthen the collar 50. Unlike prior art collars made by investment casting and/or machining processes (see U.S. Pat. Nos. 4,454,711, 4,322,945 and 6,497,105, for example), the use of sheet metal advantageously permits a very light weight and inexpensively-provided part, due to its simple geometry, and yet provides good performance and reliability.

Unlike the prior art, the mounting assembly of the present invention is more resistant to radial cracks around the dome opening 26 and the floating collar assembly 28 cracks at the points of fixation between the flange 30 and the dome 22, and the flange 30 and the cap 40. Contrary to the prior art which teaches welding the floating collar assembly to the edge of dome opening 26 or the inner surface 23 of the liner 22 and thereby needing to provide for an unprotected band of metal on the inner surface of the dome 22, the design and method of the present invention instead allows the thermal barrier coating 25 to extend all the way to the edge of the opening 26, protecting the entire surface of the dome from hot air. As well, the mounting assembly is also better protected by having the fixation points brazed from the outside, thereby protecting them from the hot air and potential cracking.

The above description is meant to be exemplary only, and one skilled in the art will recognize that changes may be made to the embodiments described without departing from the scope of the invention disclosed. For example, the present invention may be applied to any gas turbine engine, and is particularly suitable for airborne gas turbine applications. The means by which flange 30 is mounted to cap 40 may be different than that described. For example legs 36 may be replaced or supplemented with a continuous or discontinuous flange or lip, and/or may extend from flange 30, cap 40 or both. The mode of anti-rotation may be any desirable. Though brazing is preferably, other bonding methods which would allow the pieces to be fixed from the outside of the combustor may be used. Other modifications which fall within the scope of the present invention will be apparent to those skilled in the art, in light of a review of this disclosure, and such modifications are intended to fall within the equivalents accorded to the appended claims.

The invention claimed is:

1. A floating collar and combustor arrangement for receiving a fuel nozzle, comprising:

a combustor having an opening defined in a dome thereof for receiving the fuel nozzle, the combustor having an inner surface and an outer surface;

a mounting arrangement comprising a mounting flange circumscribing the opening, the mounting flange being fixedly bonded from outside of the combustor to the outer surface thereof, and a cap spaced-apart in an axial direction relative to the combustor from the mounting flange, the cap fixed to the mounting flange;

a floating collar slidably trapped between the mounting flange and the cap such that relative axial movement is substantially restrained but relative radial movement is permitted, the floating collar having a central aperture substantially aligned with the opening in the dome and adapted for receiving the fuel nozzle; and a thermal barrier applied to the inner surface of the combustor all the way to an edge of the opening in the dome.

2. The assembly of claim 1 wherein the mounting flange is brazed from a radially outer side thereof opposite the opening of the combustor such that the braze is not exposed to hot combustor temperatures.

3. The assembly of claim 1 wherein the thermal barrier is a thermal barrier coating covering the inner surface of the dome until the edge of the opening.

4. The assembly of claim 1, wherein the cap is brazed to the mounting flange outwardly of the combustor.

5. The assembly of claim 1 wherein the mounting flange is brazed from a radially outer side thereof opposite the opening of the combustor such that the braze is not exposed to hot combustor temperatures, the braze extending about the opening in the combustor.

6. A floating collar and combustor arrangement for receiving a fuel nozzle, comprising:

a combustor having an opening defined in a dome thereof for receiving the fuel nozzle, the opening being circumscribed by an edge, the combustor having an inner surface and an outer surface;

a mounting arrangement comprising a mounting flange circumscribing the opening, the mounting flange being fixedly bonded from outside of the combustor to the outer surface thereof, the mounting flange having an end abutted against the outer surface of the combustor outside of the opening, the mounting flange and the combustor being bonded by a joint provided between a radially outer surface of the end of the mounting flange and the outer surface of the combustor radially outwardly from the edge of the combustor opening, and a cap spaced-apart in an axial direction relative to the combustor from the mounting flange, the cap fixed to the mounting flange;

a floating collar slidably trapped between the mounting flange and the cap such that relative axial movement is substantially restrained but relative radial movement is permitted, the floating collar having a central aperture substantially aligned with the opening in the dome and adapted for receiving the fuel nozzle; and a thermal barrier applied to the inner surface of the combustor all the way to the edge of the opening in the dome.

* * * * *